United States Patent [19]

Malmanger

[11] Patent Number: 4,765,480

[45] Date of Patent: Aug. 23, 1988

[54] CONTAINER WITH COLLAPSIBLE LID MEMBERS

[75] Inventor: John A. Malmanger, Vashon Island, Wash.

[73] Assignee: Xytec Plastics, Inc., Tacoma, Wash.

[21] Appl. No.: 81,122

[22] Filed: Aug. 3, 1987

[51] Int. Cl.[4] ..... B65D 21/02; B65D 21/06; B65D 43/16; B65D 51/24

[52] U.S. Cl. ..... 206/506; 206/508; 206/518; 220/329; 220/337

[58] Field of Search ..... 206/506, 507, 508, 518, 206/519, 520, 515; 220/329, 331, 333, 334, 337, 339, 343

[56] References Cited

U.S. PATENT DOCUMENTS

| | | | |
|---|---|---|---|
| 2,112,451 | 3/1938 | Best | 206/506 |
| 3,270,913 | 9/1966 | Bridenstine | 206/507 |
| 3,463,345 | 8/1969 | Bockenstette | 206/508 |
| 3,900,106 | 8/1975 | Cantales | 206/519 |
| 4,213,539 | 7/1980 | Reuter | 220/333 |
| 4,391,386 | 7/1983 | Moret | 220/343 |
| 4,572,374 | 2/1986 | Sirotkin | 206/518 |
| 4,685,567 | 8/1987 | Webb | 206/508 |

*Primary Examiner*—George E. Lowrance
*Attorney, Agent, or Firm*—Kolisch, Hartwell & Dickinson

[57] ABSTRACT

A container with lid members closing off the top of the container. The lid members may be swung on opening of the container to hang downwardly outside the container. The lid members are collapsible, and when collapsed, may be swung to extend downwardly on the inside of the container. Containers are nestable with the lid members on the inside of the container.

8 Claims, 4 Drawing Sheets

CONTAINER WITH COLLAPSIBLE LID MEMBERS

BACKGROUND AND SUMMARY OF THE INVENTION

This invention relates to a container or box, and more particularly, to such a container which is reusable in that such may be used to package products shipped from a supplier to a purchaser and when emptied returned to the supplier to be sued again in the packaging of product.

In the past it has been the practice to supply product, such as automotive parts, to a consumer, such as an automobile manufacturer, using containers made of cardboard or other materials which after use are then destroyed. With a large manufacturer this results in a vast amount of material which must be collected, stored and then destroyed or otherwise reprocessed, which is time consuming and expensive in requiring personnel and equipment to perform the work involved, space used in storage, etc. In discussing the automotive industry, it is not intended in any way to limit the invention to such usage, as the container contemplated may be used in the packaging and shipment of a vast number of products such as machine parts, electronic material, food products, etc.

Very generally describing a preferred embodiment of the invention, it may comprise a floor or base with upstanding sides imparting a slightly tapered but box-like configuration to the container. Hingedly connected to close off the top of the container are lid members. These are collapsible and then swingable inwardly to produce a configuration where multiple containers may be stacked one within another. In a noncollapsed state the lid members are supported in covering relation over the top of the container by side walls and through mutual interaction provide a seat for the resting thereupon of another container. The lid members may be swung outwardly to hang downwardly on the outside of the container in a vertical position, minimizing the chance of inadvertently striking the lid members during use. The container may be made of structural-foam, molded, high-density polyethylene, thereby to have requisite strength and minimal mass.

Thus, a general object of this invention, is to provide an improved reusable container for the shipment of product from one place to another.

Another object is to provide such a container having attached lid members that in a noncollapsed state cooperate to close off the top of the container. A related object is to provide such a container where the lid members have a collapsed state which enable them to be swung inwardly into the container, the container then preferably having a configuration enabling the nesting therewithin of a like container.

A further object is to provide a container of the above general description and having lid members where the lid members have a construction enabling the stacking thereupon of another container of like configuration.

In its specific and preferred embodiment of the invention, the lid members may be swung outwardly to hang downwardly along the outside of the container with the lid members substantially vertically disposed.

These and other objects and advantages are attained by the invention, described herein in conjunction with the accompanying drawings, wherein.

Figure 1:
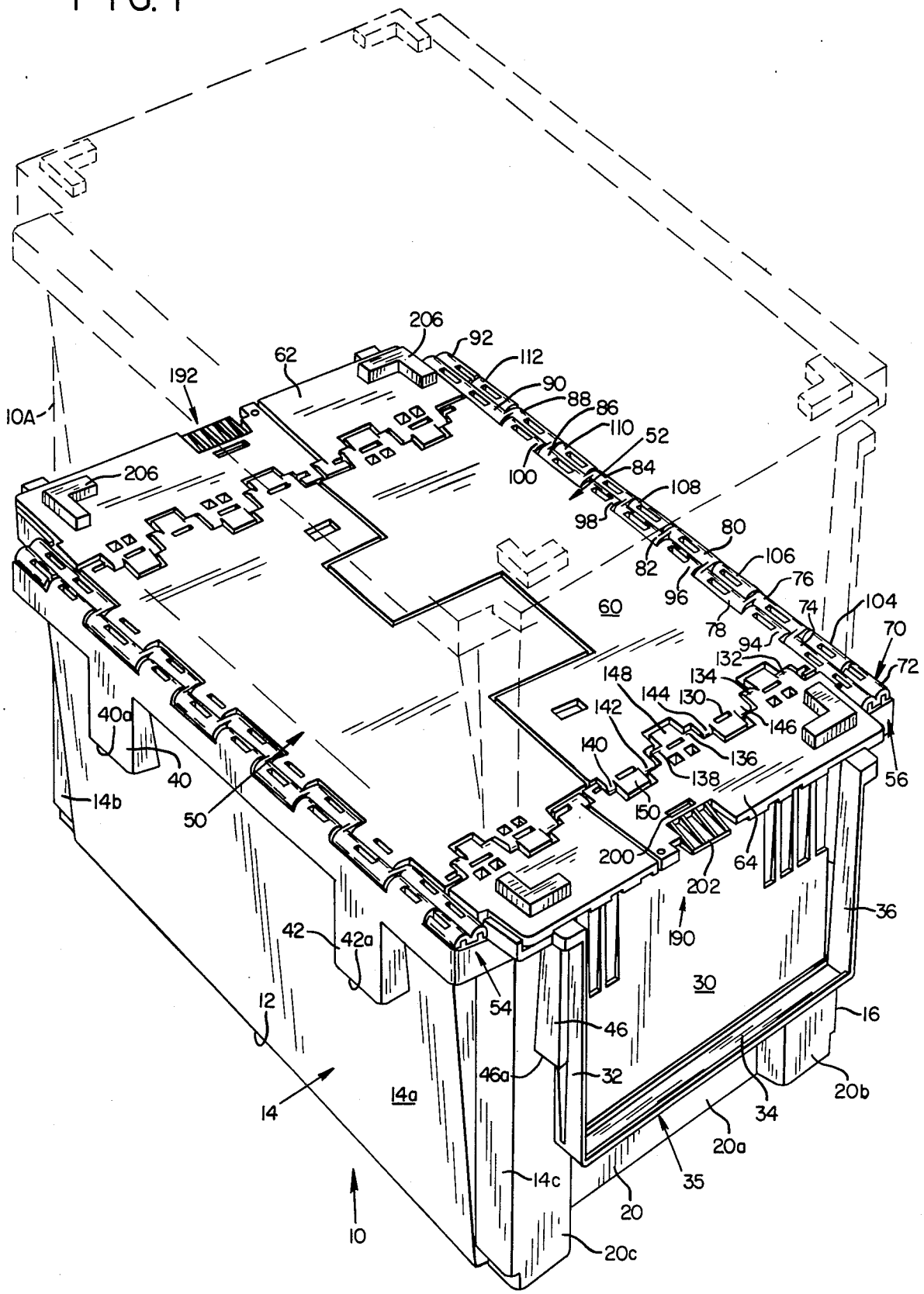
FIG. 1 is a perspective view of a container according to a preferred embodiment of the invention, the container having opposed lid members closing off the top of the container.
Figure 2:
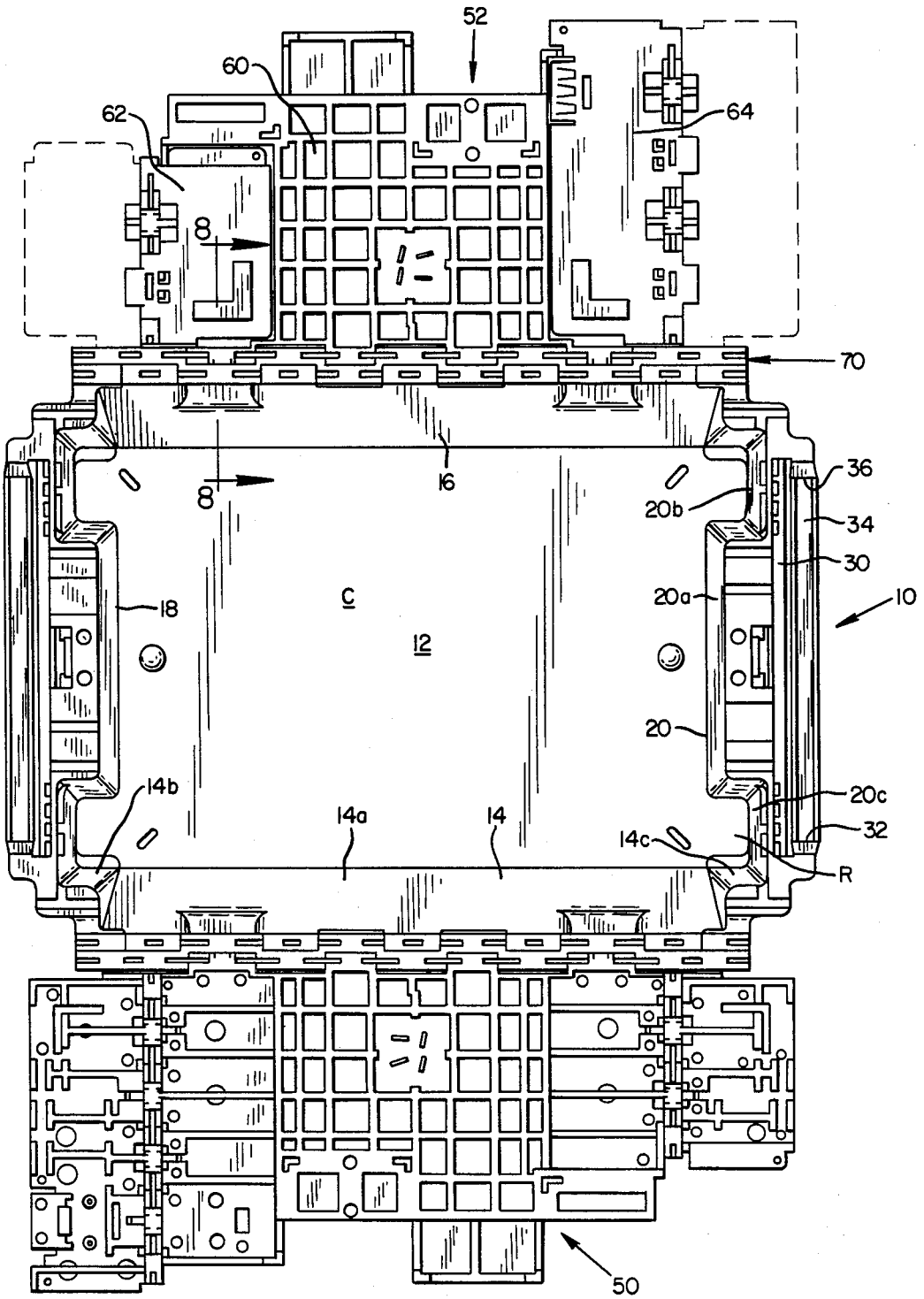
FIG. 2 is a top plan view of the container shown in FIG. 1, with the lid members shown in a position extending horizontally outwardly to the sides of the container, the lid member shown in solid outline at the top of the figure being in a collapsed state and the lid member shown at the bottom of the figure being in a noncollapsed state.

Referring now to the drawings and first of all more particularly to FIGS. 1 and 2, a container as contemplated is indicated generally at 10 and includes an essentially rectangular floor or base 12, a first pair of side walls 14, 16 extending upwardly and integrally joined to a first set of opposed margins of floor 12, and a second pair of opposed side walls 18, 20 integrally joined to and extending upwardly from another set of opposed margins of the floor. The walls 14, 16 and 18, 20 are slightly inclined, so as to converge on each other progressing downwardly in the container, and impart a generally box-like configuration to the container. The floor and side walls may be molded as an integral unit from a plastic material such as structural-foam polyethylene.

With continued reference to FIGS. 1 and 2, wall 14 has a central expanse **14*a* which inclines at a slightly greater angle than marginal expanses 14*b*, 14*c*. Wall 16 is similarly constructed. Wall 20 has a central expanse, 20*a* disposed inwardly in the container from marginal expanses 20*b*, 20*c*. Wall 18 opposite wall 20 is similarly constructed. The various side walls described bound and define therewithin an article-receiving chamber C shown in FIG. 2. Wall margins, for example margins 14*c*, 20*c*, define, as shown on FIG. 2 and on the inside of the container, a channel-shaped region R adjacent a corner of the container which is a continuation of chamber C. A similar region appears at every corner of the container. On the outside of the container margins, such as margin 14*c* and margin 20*c*, and as seen in FIG. 1**, define a post-like protuberance, and such a post-like protuberance is repeated at each corner of the container. Two like containers may be mounted with one nested within the other, and with this positioning a post-like protuberance at each corner of the container fits within a channel-shaped region R provided at each corner of the container on the inside of the container.

Figure 4:
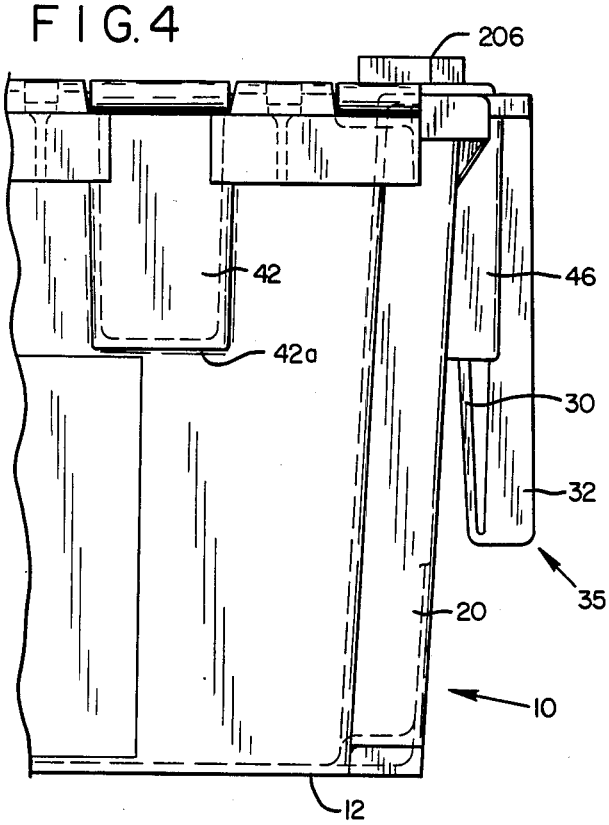
FIG. 4 is a side elevation of an end portion of the container.

As can be seen with reference to FIGS. 1, 2 and 4, joined to and extending downwardly from the upper edge of each of the walls 18, 20 is a handle web 30 forming part of a handle 35. Strengthening flanges 32, 34, 36 join with and extend outwardly from margins of a handle web, the flanges 32, 36 along the sides of a handle web being slightly convergent. The handles provided by the handle webs and their associated flanges permit a user easily to pick up and otherwise manipulate a container, with the fingers of a hand encircling and fitting fully about the base of a handle. With handle web 30 diverging slightly outwardly progressing downwardly in the container (see FIG. 4), and with the incline mentioned in flanges 32, 36, when two containers are positioned with one nested within the other, the handle at one end of the nested container slides over and fits snugly within the handle at an end of the nesting container.

Referring to FIG. 1, each of the side walls 14, 16 adjacent its upper margin is formed to present a pair of external bosses, illustrated for wall 14 by bosses 40, 42. These bosses are disposed outwardly from the general plane of the exterior of a side wall. The bottoms 40*a*, 42*a* of bosses 40, 42 lie in a common horizontal plane shared by the bottoms of similar bosses (not shown as obscured in the drawing in FIG. 1) formed in wall 16 which is opposite wall 14. On the inside of the container, each boss defines a hollow region shown at 43 in FIG. 8.

Each handle 35 is provided at each of its lateral margins with an integrally formed handle boss, such as the one illustrated at 46 in FIG. 1, terminating at bottom 46*a*. The bottoms of the various handle bosses lie in a common plane, which is the plane shared by the bottoms of bosses 40, 42. With two like containers mounted so that one is nested within another, the bottoms of the various bosses described in the nested container come up against top marginal portions in the nesting container to limit movement of the nested container within the nesting container.

Lid structure is provided in the container utilizable in closing off the top of the container, as when shipping product from one location to another. The lid structure takes the form of a pair of opposed lid members hingedly connected to side walls in the container (so as to be a permanent part of the container), as now will be described.

More specifically, and referring to FIG. 1, these lid members have been given the general reference numerals 50 and 52. Lid member 50 is hingedly connected by hinge means 54 to the upper margin of side wall 14, and lid member 52 is hingedly connected by hinge means 56 to the upper margin of side wall 16.

The two lid members are the same in construction and only one will be described in detail. Thus, and considering lid member 52, and with reference to FIGS. 1, 2 and 3, the lid member includes a central expanse 60, and forming opposite extremities of the lid member, support or flap expanses 62, 64.

A lid member is hingedly connected to a side wall only through its central expanse and through a hinge means in the form of a double hinge.

Further elaborating, a hinge body is shown at 70 which includes, and progressing from right to left in FIG. 1, a sleeve section 72 joined to an offset sleeve section 74. The latter is joined to a sleeve section 76 aligned with section 70, and section 76 joins with a sleeve section 78 aligned with section 74. Sleeve section 78 joins with a section 80 aligned with section 76, and section 80 joins with a section 82 aligned with section 78. Section 82 joins with a section 84 aligned with section 80, and section 84 joins with a section 86 aligned with section 82. Section 86 joins with a section 88 aligned with section 84, and section 88 joins with a section 90 aligned with section 86, section 90 joining section 92 aligned with section 88. Interspersed with sections 74, 78, 82, 86 and 90 of the hinge body are sleeve sections 94, 96, 98, 100 which are an integral part of central expanse 60.

A hinge pin 102 (see FIG. 8) extends through sleeve sections 74, 78, 82, 86 and 90 and the sleeve sections which are interspersed therewith and are part of the central expanse, to provide for relative movement about one hinge axis which extends horizontally and adjacent the upper edge of a side wall in the container.

Figure 8:
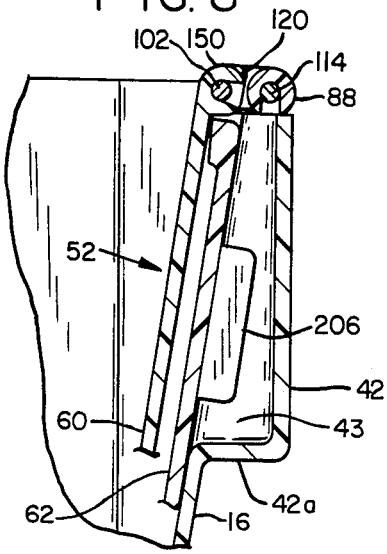
FIG. 8 is a cross-sectional view, similar to FIG. 5, but showing portions of a lid member with such collapsed and extending down on the inside of the container.

Sleeve sections 104, 106, 108, 110 and 112 forming an integral part of side wall 16 are interspersed with sleeve sections 72, 76, 80, 84, 88, 92, and received within these interspersed sleeve sections is a hinge pin 114 (see FIG. 8) which provides another pivot axis in the hinge means, which axis is offset and parallel to the axis provided by hinge pin 102. With the double hinge described, and with the lid member collapsed in a manner to be described, lid member 52 is swingable downwardly to lie along the inside of wall 16 as shown in FIG. 8, with the hinge body lying flat on the top of wall 16 and pivoting occurring about hinge pin 102. The lid member may also be positioned as shown in FIG. 6, with such extending vertically downwardly along the outside of the container, and the hinge body rolled over to place hinge pin 102 outwardly of hinge pin 114.

Figure 5:
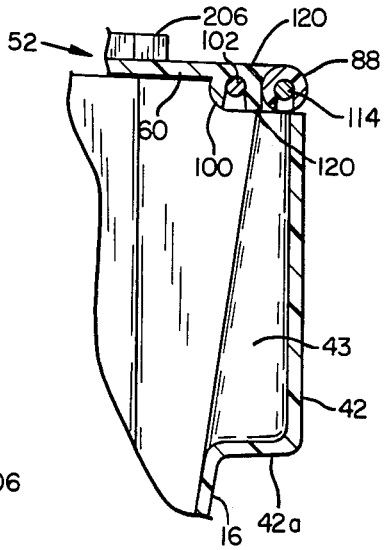
FIG. 5 is a cross-sectional view, taken generally along the line 5—5 in FIG. 3 and showing upper portions of the container.
Figure 6:
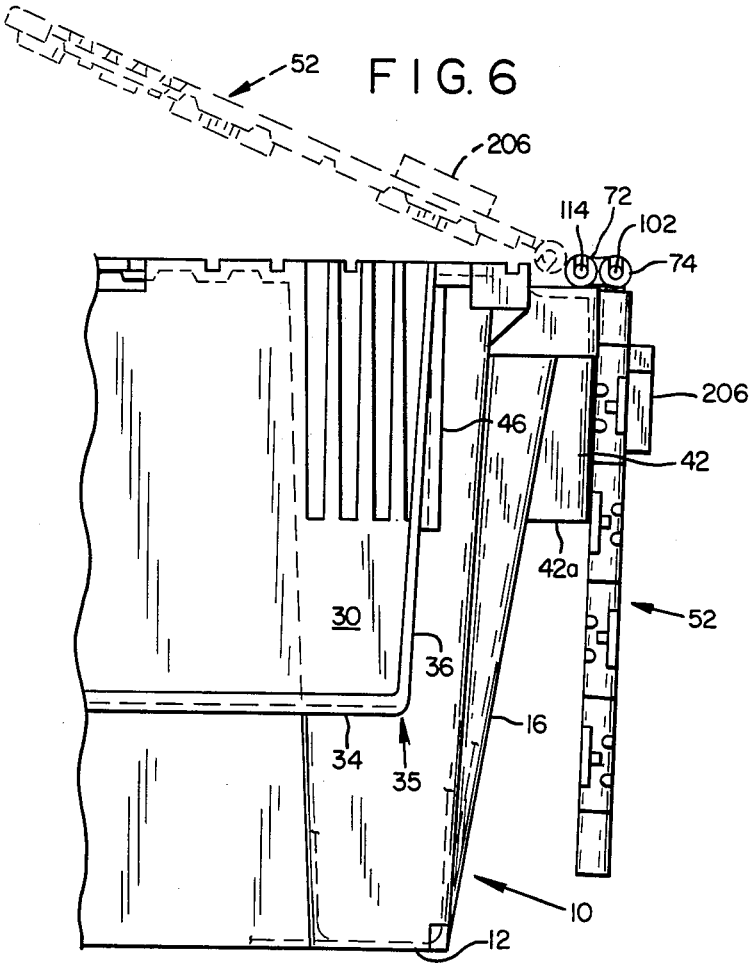
FIG. 6 is an end elevation of a portion of a container, showing in dashed outline a lid member in a slightly raised and noncollapsed state, and showing in solid outline a lid member in a collapsed state and hanging outside the container.

Referring to FIG. 6, lid member 52 is free to swing in a counter-clockwise direction about hinge pin 102, until such reaches a horizontal position extending to the right and substantially in the plane of hinge pins 102, 114. Further unrestricted swinging movement about hinge pin 102 is inhibited by means to be described, so that on further swinging in a counter-clockwise direction, such occurs with the lid member and hinge body moving as one and pivoting about hinge pin 114. This movement continues until the hinge body and lid member 50 reach the position shown in FIG. 5, with hinge pin 102 now to the left of hinge pin 114 and with the lid member still in the plane of hinge pins 102, 114, but now extending to the left and over the top of the container. On reaching the position shown in FIG. 5, the lid member may be swung further in a counter-clockwise direction, and to reach the position shown in FIG. 8, with this movement being about hinge pin 102 and after overcoming resistance offered by means now to be described.

Specifically, and referring to FIG. 5, selected ones of the sleeve sections joined to expanse 60 in the lid member, as exemplified by sleeve section 100, may be provided with one or more protrusions 120 which come up against a side of a laterally offset sleeve section, such as sleeve section 88 in the hinge body, with the lid member extending essentially in the plane of hinge pins 102, 114. These projections impede free movement of lid member 50 in a counter-clockwise direction relative to hinge pin 102, but yieldably accommodate such movement with the projections giving to move across the side of the offset sleeve section when the lid member is forced downwardly from the position shown in FIG. 5. On moving past the offset sleeve section, the lid member swings freely to the position shown in FIG. 8, which is a position extending downwardly along the inside of the container.

What has been described, therefore, is an operation wherein with the lid member swung from the position shown in FIG. 6 to the one as shown in FIG. 8, the lid member first swings about hinge pin 102 until the lid member reaches alignment with pins 102, 114, the lid member and hinge body then swinging as one about hinge pin 114 until the position shown in FIG. 5 is reached, and then after overcoming the resistance described the lid member swings downwardly about hinge pin 102.

Considering now the flap expanses, and first of all expanse 64 (refer to FIG. 1), such is hingedly connected to central expanse 60 by hinge pin 130. Such passes through sleeve sections such as sleeve section 132, 134, 136, 138 which are part of flap expanse 64, and sleeve sections 140, 142, 144, and 146 which are integral with the central expanse. The hinge pin and sleeve sections provide a hinge means accommodating swinging movement of the flap expanse from a position which is a continuation of the plane of central expanse 60, i.e., a noncollapsed position, to a position extending adjacent the underside of the central expanse as shown in FIG. 2, i.e., a collapsed position. Preventing movement of the flap expanse outwardly from the plane of central expanse 60, i.e., upperly and toward the viewer as illustrated in FIG. 3, are tabs such as tab 148 integral with expanse 64, and tab 150 integral with expanse 60, seated within shallow pockets provided in complementary expanses.

Figure 9:
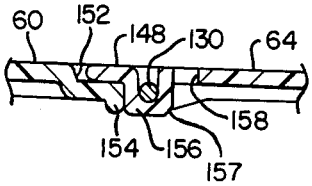
FIG. 9 is a cross-sectional view, somewhat enlarged, taken generally along the line 9—9 in FIG. 3.

Referring to FIG. 9, which shown in cross section tab 148 which is part of flap expanse 64 and pocket 152 receiving it formed in central expanse 60, a construction has been provided wherein, with a flap expanse in its noncollapsed position, i.e., extending in the plane of the central expanse, the flap expanse will tend to stay in that position. A snap-action release system permits shifting of the flap expanse to a completely collapsed state lying underneath the central expanse. Further explaining, under tab 148 and pocket 152, central expanse 60 is provided with one or more projections such as the one shown at 154, which are slightly yieldable and coactable with a squared-off portion including shoulders 156, 156 formed underneath pin 130 in expanse 64. With expanse 64 swung downwardly or clockwise in FIG. 9 about hinge pin 130, projection 154 yieldably permits shoulder 156 to move thereacross, with expanse 64 reaching an intermediate position which is normal to expanse 60. Continued clockwise movement of flap expanse 64 places it underneath expanse 60, with projection 154 in the process yieldably permitting shoulder 157 to move thereacross. With flap expanse 64 under expanse 60, i.e., collapsed, apertures 158 in flap expanse 64 receive projections 154.

A similar hinge construction with tabs interconnects flap expanse 62 with central expanse 60, and the flap expanses and central expanse present in lid member 50.

Figure 3:
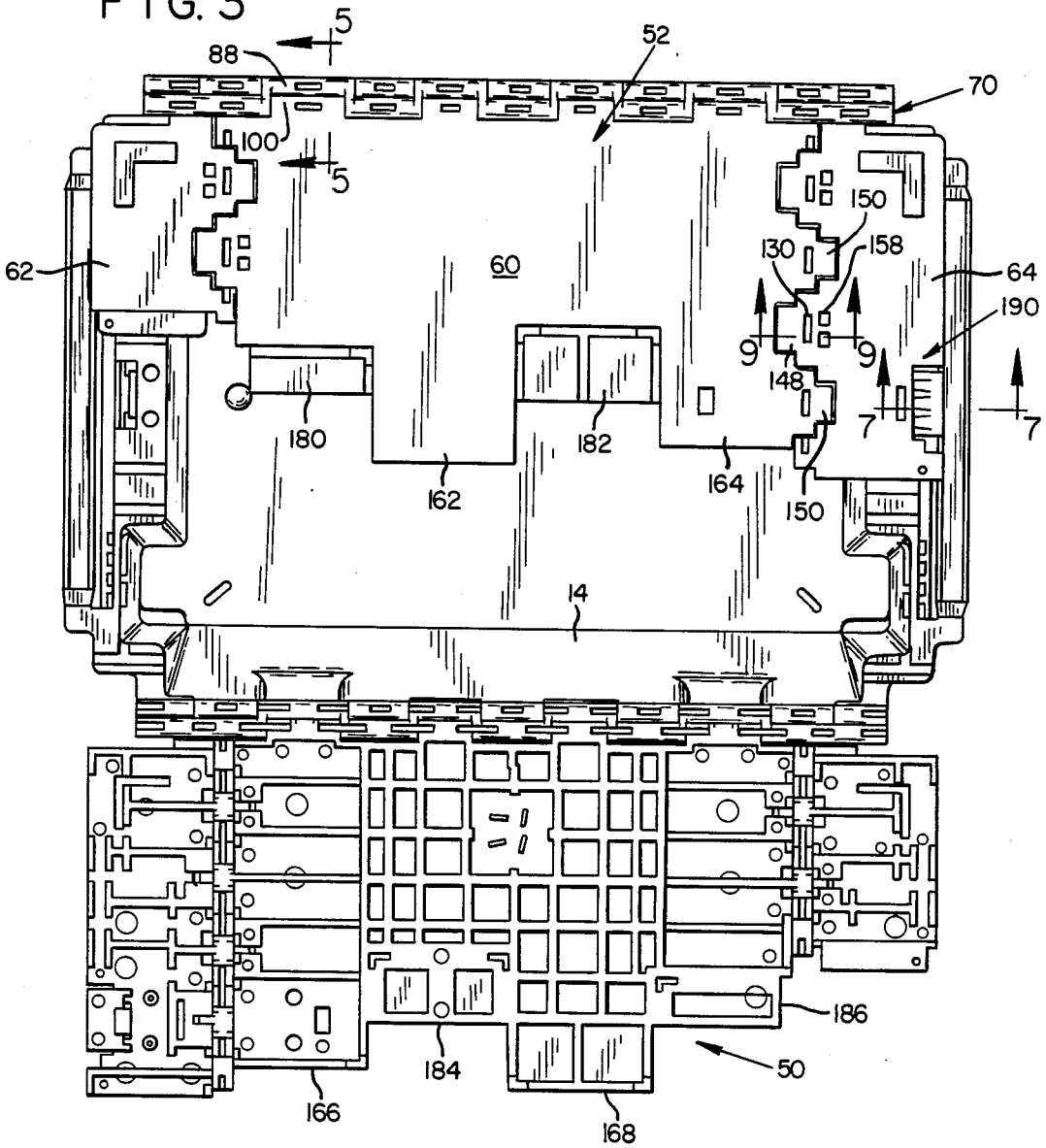
FIG. 3 is a view similar to FIG. 2 but showing one of the lid members in a noncollapsed state in covering relation over part of the container and the other lid member extending horizontally outwardly to the side of the container.

It will be noted, and with reference to FIG. 3, that expanse 60 in lid member 52 terminates in a pair of support tabs 162, 164, and lid member 52 terminates in support tabs 166, 168 which are staggered with tabs 162, 164. Fitting underneath tabs 166, 168 with the lid members in a closing position are shelf or shoulder portions 180, 182 provided in lid member 52. Similar shelf portions 184, 186 in lid member 52 fit under and support tabs 162, 164 in lid member 50. The lid members swing together to reach a closing relationship over the container with the tabs on the respective lid members moving past each other and finally coming to rest on the shelf portions described. With the lid members in their closing positions, they become firmly supported, with upper edges of the side walls 18, 20 supporting side margins of the lid members and with the lid members between these side walls mutually supporting each other.

Figure 7:
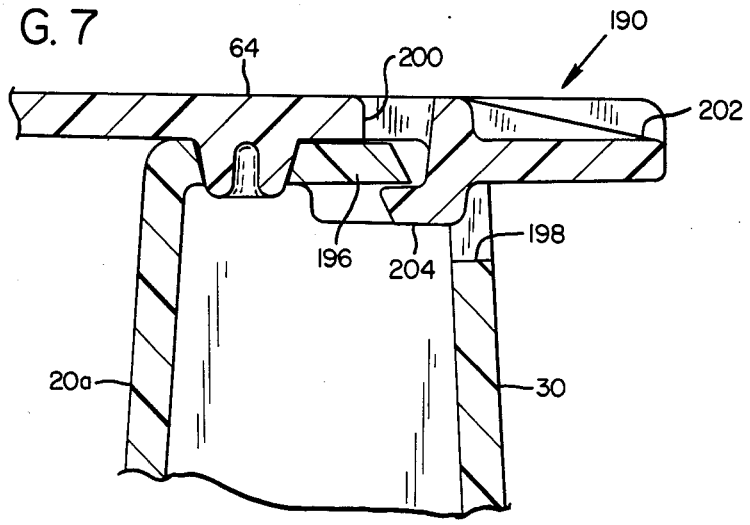
FIG. 7 is a cross-sectional view, somewhat enlarged, taken generally along the line 7—7 in FIG. 3.

A snap-acting lock system is provided for holding the lid members in their closing position. Specifically, and referring to FIG. 1, such is shown generally at 190 on one side of the container and at 192 at the other side of the container. The systems have similar construction and only system 190 will be described in detail. Further explaining, and referring also to FIGS. 3 and 7, expanse **20*a* of side wall 20 is formed with a ledge 196. The upper portion of handle web 130 is apertured at 198. Flap expanse 64 is relieved at 200 and provided with an integrally formed finger tab 202 joining with a ledge 204. With the lid member moved to a closing position, with slight flexing of the interacting parts, ledge 204 moves beyond ledge 196 to produce the snap-locked condition shown in FIG. 7. To release the lock, finger tab 202 is flexed upwardly in FIG. 7 to move ledge 204 out of engagement with ledge 196**.

Lid members 50, 52, and referring to FIG. 1, have integrally formed therewith adjacent corners of the box or container, and with the lid members in their closing position, right-angle projections shown at 206. These right-angle projections throughout their interiors receive the corners of a similar container rested on top of the lid members, as exemplified by the container indicated in dot dashed outline at 10A in FIG. 1. Thus, they provide seating means for seating the bottom of a container, promoting the stacking of one container over another with the lid members of the containers closed and the containers, for example, filled with product.

With a lid member collapsed and swinging to a position extending downwardly inside the container, as shown in FIG. 8, bottom regions 43 on the inside of bosses 42 receive projections 206.

Summarizing features and the general operation of a container as described, the container when filled and used to transport product from a supplier to a customer would appear as shown in FIG. 1, with the lid members closed and snap locked through means 190, 192. The lid members are firmly supported and can provide support for a like container rested thereon, with such like container seated within the seating means provided by elements 206. The container is easily opened up with release of lock systems 190, 192 to expose the contents of the container. The lid members may be swung aside and to the position shown in FIG. 6 wherein the lid members hang vertically downwardly on the outside of the container.

With the container emptied, and lid members in their collapsed state, the lid members are swingable inwardly to extend downwardly on the inside of the container, as illustrated by the lid member shown in FIG. 8. With the lid members so positioned, nesting of one container within another is accommodated. This is a distinct advantage when it comes to storing or returning the containers. Important, of course, is that this nesting is done without increasing the side-to-side dimension of the container, as would be the case were nesting performed with the lid members outside the container.

The container contemplated is light in weight, while at the same time being of a sturdy construction well adapted to take the normal wear and tear to which such a container might be subjected.

While a particular embodiment of the invention has been described, obviously variations and modifications are possible.

It is claimed and desired to secure by Letters Patent:

1. A reusable container comprising:

a rectangular floor bounded by first and second sets of opposed margins, first and second pairs of opposed side walls joined to and extending upwardly from said first and second sets, respectively of said margins imparting a box-like configuration to the container and bounding an article-receiving chamber, a pair of opposed lid members having rear margins and opposite forward margins, and hinge means hingedly connecting the rear margins of the lid members to respective side walls of said first pair of side walls, said lid members have a closed position where their forward margins are opposite and against each other and the lid members lie in covering relation over said chamber, at least one lid member including a central expanse and a support flap forming a side margin thereof extending between the forward and rear margins of the lid member, such support flap resting on one of the side walls of said second pair with the lid members in their said closed position, said support flap being movably mounted on said expanse so as to be shiftable to a collapsed position where such clears said one of the side walls of said second pair thus to enable the lid member to swing inwardly to be disposed in said chamber.

2. The container of claim 1, wherein said hinge means for said one lid member has a construction enabling said one lid member to swing between a position extending downwardly in said chamber adjacent the inner surface of a side wall of said container, to a position extending substantially vertically downwardly on the outside of said chamber adjacent the outer surface of the same side wall.

3. The container of claim 2, wherein said hinge means is a double hinge having a hinge body hinged at one location to the side wall and at another location to the lid member and providing for swinging movement of said one lid member about a pair of substantially parallel and adjacent axes.

4. The container of claim 1, wherein the other of said pair of lid members includes a central expanse and a support flap forming a side margin thereof extending between the forward and rear margins of the lid member, said support flap resting on the other of the side walls of said second pair with the lid members in their said closed position, the support flap of the other lid member being movably mounted on said expanse of the other lid member and shiftable thereby to a collapsed position where the lid member clears said other side of said pair of side walls thus to enable the other lid member to swing inwardly to be disposed in said chamber together with said one lid member.

5. The container of claim 1, wherein said forward margins of the lid members include coacting shoulder portions constructed and arranged whereby the lid members mutually support each other with the lid members in their said closed position.

6. A reusable container comprising:

a rectangular floor bounded by first and second sets of opposed margins, first and second pairs of opposed side walls joined to and extending upwardly from said first and second sets, respectively, of said opposed margins imparting a box-like configuration to the container and bounding an article-receiving chamber, the side walls inclining toward each other progressing downwardly from the top of the container, a pair of opposed lid members having rear margins and opposite forward margins and hinge means hingedly connecting the rear margins of the lid members to respective side walls of said first pair of side walls, said lid member having collapsed and noncollapsed states and in a noncollapsed state having a closed position where their forward margins are opposite and against each other and the lid members lie in closing relation over said chamber, said lid members in their collapsed state being swingable inwardly to extend in snug adjacency against inner sides of said first pair of side walls to leave a space within said chamber to enable nesting therewithin of another like container, the hinge means connecting the lid members to said first pair of side walls of the container having a construction enabling the lid members to swing from the position of snug adjacency against inner sides of the side walls to a position wherein the respective lid members extend substantially vertically downwardly on the outside of said container, the hinge means for each lid member including an elongate hinge body, pivot means pivotally mounting one side of the hinge body to a side wall, and pivot means pivotally mounting an opposite edge of the hinge body to the lid member.

7. The container of claim 6, wherein the lid members each include at end extremities support flaps hingedly connected to a central expanse of the lid member, said support flaps forming side margins of the lid member extending between the lid members forward and rear margins, said support flaps resting on said second pair of side walls with the lid members in a noncollapsed state, and said support flaps swinging to a position underlying the central expanses of lid members with the lid members in a collapsed state.

8. The container of claim 7, which further includes releasable means for holding the support flaps in their underlying the central expanses of the lid members.

* * * * *